United States Patent [19]

Mitchell

[11] Patent Number: 4,662,344

[45] Date of Patent: May 5, 1987

[54] ARCHERY DEVICE

[76] Inventor: Phillip J. Mitchell, 6414 Bennett Lake Rd., Fenton, Mich. 48430

[21] Appl. No.: 691,399

[22] Filed: Jan. 14, 1985

[51] Int. Cl.[4] ..... F41B 7/00; F41B 5/00

[52] U.S. Cl. ..... 124/22; 124/24 R; 124/88

[58] Field of Search ..... 124/20 R, 20 B, 21, 124/22, 23 R, 24 R, 25, 88, 90, DIG. 1, 38

[56] References Cited

U.S. PATENT DOCUMENTS

| | | | |
|---|---|---|---|
| 213,851 | 4/1879 | Streeter | 124/22 |
| 306,234 | 10/1884 | Fox | 124/22 |
| 1,403,402 | 1/1922 | Grasso | 124/38 |
| 2,608,188 | 8/1952 | Howard | 124/88 |
| 3,004,532 | 10/1961 | Vance | 124/23 R |
| 3,018,770 | 1/1962 | Saunders | 124/22 |
| 3,171,397 | 3/1965 | Daly | 124/24 R |
| 3,572,312 | 3/1971 | Foster | 124/23 R |
| 3,595,213 | 7/1971 | Storer | 124/23 R |
| 3,834,368 | 9/1974 | Geiger | 124/23 R |
| 3,987,777 | 10/1976 | Darlington | 124/23 R |
| 3,993,039 | 11/1976 | Groves et al. | 124/23 R |
| 4,169,453 | 10/1979 | Hunsicker | 124/20 R |
| 4,169,456 | 10/1979 | Van House | 124/61 |
| 4,411,248 | 10/1983 | Kivenson | 124/20 R |

*Primary Examiner*—Richard C. Pinkham
*Assistant Examiner*—Benjamin Layno
*Attorney, Agent, or Firm*—Basile, Weintraub & Hanlon

[57] ABSTRACT

An archery device 10 includes a frame 12 and a handle section 14. A drawstring 24 spans the frame and has first and second ends 30,32 formed of an elastomeric material and an intermediate section 34 of conventional drawstring material. A pulley 44 or 46 is associated with each end of the drawstring to facilitate the drawing back thereof. The elastomeric ends of the drawstring are adjustably secured to the frame. The frame has an elbow-engaging stabilizer which is rotatable for use by either a right or left-handed operator.

6 Claims, 2 Drawing Figures

ARCHERY DEVICE

BACKGROUND OF THE INVENTION

I. Field of the Invention

The present invention relates to archery devices. More particularly, the present invention concerns slingshot-type archery devices. Even more particularly, the present invention concerns compound slingshot-type archery devices.

II. Prior Art

Heretofore, the prior art has proposed many types of archery devices intended to facilitate both stability of arrow flight, as well as ease of drawing back on the string. Hence, the art has proposed pulley systems; wrist supports; elbow supports and the like. The prior art is exemplified by U.S. Pat. Nos. 4,169,453; 3,595,213; 3,018,770; 4,169,456; 3,572,312; 3,004,532; 3,987,777 and 3,834,368.

None of the prior art devices, however, address short-range archery, such as is associated with slingshots. Ordinarily, slingshots are constructed of conventional drawstring without any means of adjusting the tension to be applied to the string, nor with any means to control the flight.

As will subsequently be detailed, the present invention provides a slingshot-type archery device which provides adjustment to the tension to be applied to the drawstring, as well as providing a unique drawstring construction.

SUMMARY OF THE INVENTION

In accordance with the present invention there is provided an archery device, and in particular, a slingshot-type archery device which generally comprises an interiorly open frame having a pair of spaced apart legs angularly inclined with respect thereto and upstanding therefrom. A pulley is mounted at the upper end of each upstanding leg over which a drawstring extends.

A drawstring extends between and spans the two legs and overlies the bight section of the frame.

A pair of spaced apart interior pulleys engage the drawstring to facilitate the drawing back thereof. The present device, also, includes an elbow engaging means to impart stability in the use of the device for the user.

The interior pulleys are positionally adjustable in order to vary the tension applied to the drawstring. Likewise, the upstanding legs are multi-apertured for positioning an associated end of the drawstring to vary the tension.

A handle is mounted to the frame and extends into the open interior thereof.

In accordance with the present invention, the drawstring, per se, comprises first and second elastomeric end sections, the elastomeric end sections being engageable by the associated interior and leg-mounted pulley. An intermediate or middle section comprises a conventional drawstring material about which the end of the arrow is engaged.

For a more complete understanding of the present invention reference is made to the following detailed description and accompanying drawing. In the drawing, like reference characters refer to like parts throughout the several views in which:

DETAILED DESCRIPTION OF THE PREFERRED EMBODIMENT

Figure 1:
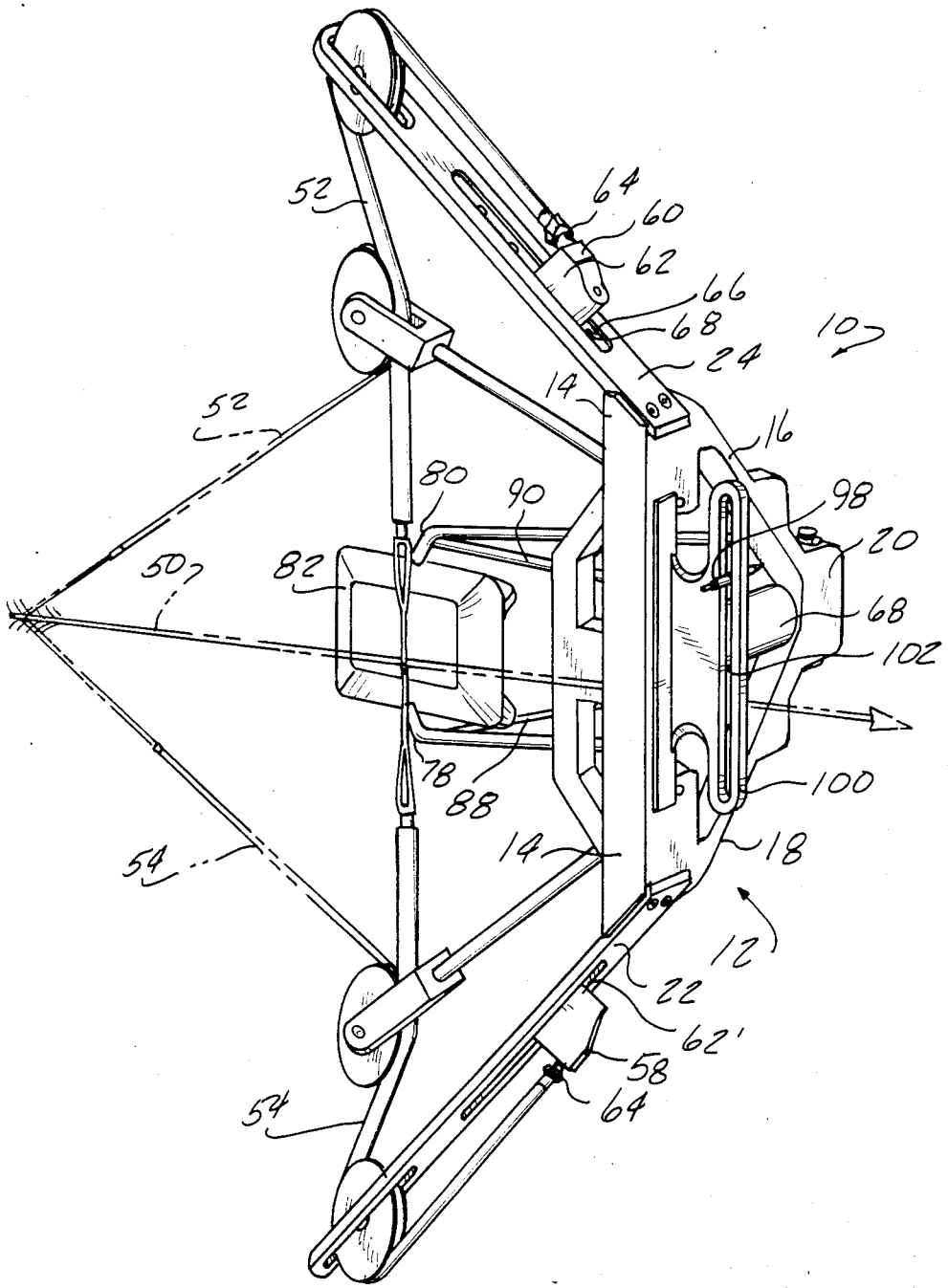
FIG. 1 is a perspective view of an archery device of the present invention.
Figure 2:
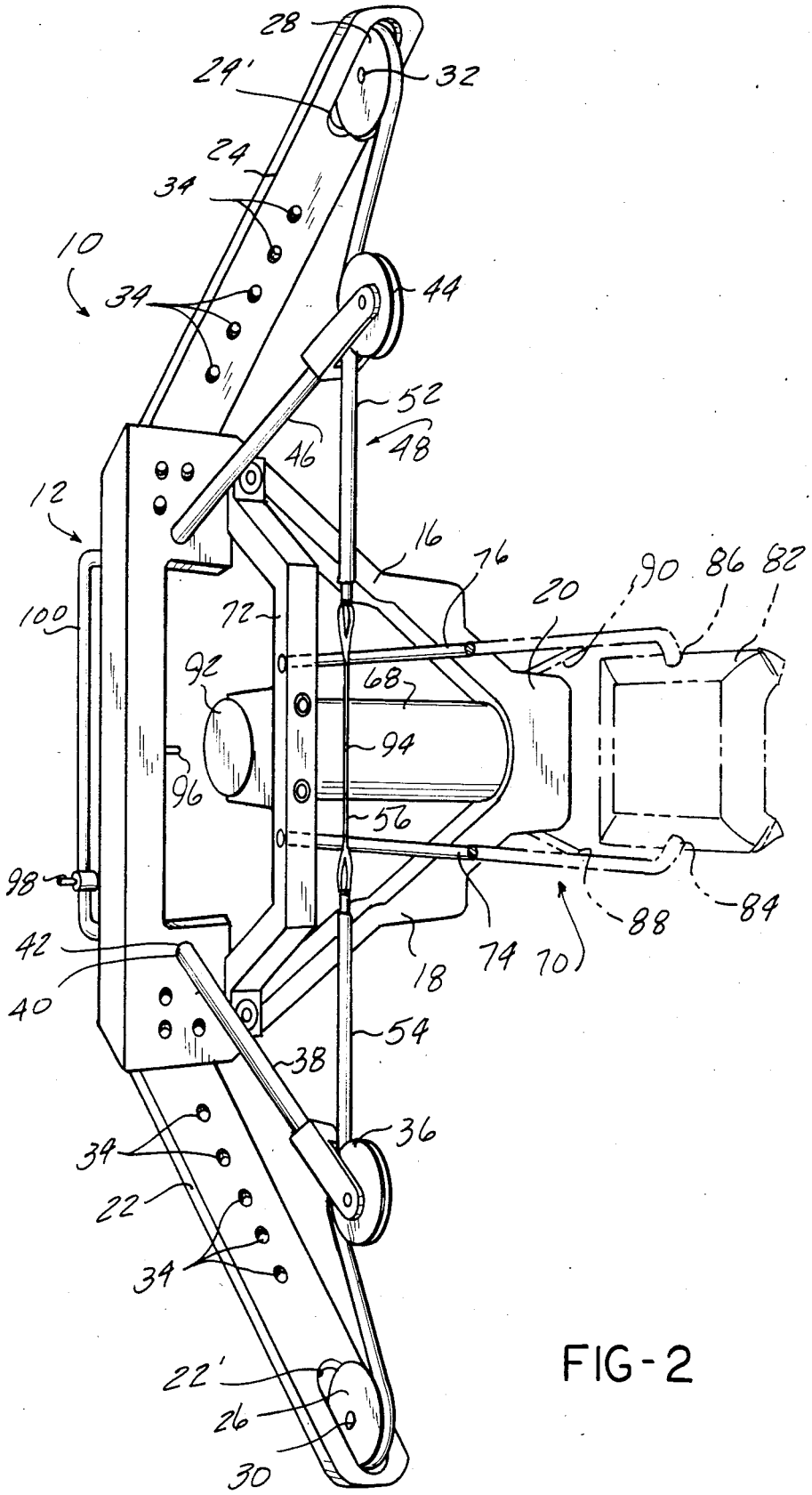
FIG. 2 is another perspective view of the archery device hereof.

Now, and with reference to the drawing, there is depicted therein an archery device, generally, denoted as 10 in accordance with the present invention. More particularly, the archery device contemplated herein is a slingshot-type archery device 10.

The device hereof, includes an open frame structure 12 having a cross-bar 14, a pair of inwardly inclined frame legs 16,18 and a base bar 20. The bar 14, frame legs 16,18 and base bar 20 are interconnected to form an open interior trapezoidal frame, as shown.

A pair of opposed upstanding legs 22,24 are secured, one each at the outer ends of the cross-bar 14. Each leg is upstanding and angularly inclined with respect to the cross-bar 14. The angle of inclination will vary between about 25° to about 75° and, preferably, is about 40° to 50°.

The upper end of each leg is provided with an opening 22',24', respectively.

A pulley 26 is rotatably mounted to the upstanding leg 22 within the opening 22' at the upper end thereof. Similarly, a pulley 28 is rotatably mounted onto the associated upstanding leg 24 at the upper end or terminus thereof, within the opening 24'. Each leg pulley 26 or 28 is journalled on an axle 30,32 which, in turn, is secured to the side of the associated leg, as shown.

Each leg 22,24 is, also, provided with a plurality of apertures 34 formed along the extent thereof. The apertures are equidistantly spaced apart. Each aperture is internally threaded to enable fixed securement of a drawstring to the leg 22 or 24 in a manner to be described subsequently.

As shown in the drawing, the present device further includes a first cross-bow mounted pulley 36. The pulley is rotatably mounted onto a shaft 38. The shaft 38 has its lower or free end provided with a series of threads 40. This enables the shaft 38 to be threadably secured to the cross-bar 14 through a complementarily threaded aperture 42 formed in the cross-bar 14. The shaft 38 and, thus, the pulley 36 is angularly inclined with respect to the cross-bar. The angle of inclination ranges between about 20° and 70° and, preferably, ranges between about 30° and 50°.

A confronting pulley and shaft arrangement 44,46 is similarly mounted onto the cross-bar 14.

It should be noted in this regard that the cross-bar 14 is provided with a plurality of threaded apertures 40 in order to vary the position of the associated shaft and pulley arrangements. Variable positioning is desirable in order to accommodate the archer's comfort in utilizing the device 10.

Referring, again, to the drawing the device 10 further includes a drawstring 48. The drawstring, as shown, extends parallel to the cross-bar 14 and is axially spaced therefrom a distance sufficient to accomodate the manuevering of an arrow 50. The drawstring 48 comprises, in accordance herewith, first and second end portions 52,54, respectively and an intermediate portion 56. Each end portion 52,54 is formed from an elastomeric material whereas the intermediate portion 56 is formed from conventional drawstring material. The intermediate portion 56 of the drawstring 48 is secured, at its opposite ends, to its respective end portions by any suitable means, such as connectors, clips, etc.

The elastomeric end portions 54,54 are, each, respectively, adjustably secured to an associated upstanding leg 22 or 24. In securing each portion 52 or 54 to its associated leg 22 or 24, the free end of each portion is fixed into a mounting block 58,60 by any suitable means.

In a preferred embodiment, each mounting block comprises a block 62,62' having a first threaded aperture (not shown). The associated free end of the elastomeric end portion 52 or 54 is secured to an externally threaded lug 64, which, in turn, is threadably received by the first threaded aperture of the mounting block 62 or 62'.

Each mounting block 62 or 62' is provided with a second aperture 66. A set screw 68 or other threaded fastener projects through the aperture 66 and is threadably received in a selected aperture 34 to positionally fix the drawstring to the legs 22,24. By mounting the block 62 or 62' to a pre-selected aperture 34 the tension on the drawstring 24 can be adjusted.

In mounting the drawstring 24 onto the device 10, the elastomeric end portions, as shown, pass under the associated interior pulley and over the associated upstanding leg pulley.

The present device 10 further includes a grip or handle 68. The grip 68 is employed for holding the device 10 when in use. The grip 68 is secured to the base bar 20 and projects therefrom into the open interior of the frame 12, as shown.

In order to stabilize the archery device 10 during use, the present invention further includes a stabilizer assembly, generally, denoted at 70. The stabilizer assembly 70 comprises a stabilizer bar 72, the opposite ends of which are secured to associated frame legs 16,18. Securement is achieved by any suitable means, such as, threaded fasteners, clips, and the like.

Each rod 74,76 has an inwardly directed flange 78,80 which define opposed mounting members for a stabilizer cuff 82. The cuff 82 is freely rotatably mounted onto the flanges 78,80. The cuff 82, generally, comprises a rectangular member having an upper and lower surface. Each sidewall has an aperture 84,86 formed therein. The apertures receive the flanges 78,80 therein, as shown.

The cuff 82 is intended to seat against the inside of a user's arm proximate the elbow. Because of the rotatability of the cuff 82, it can be employed by either a left-handed or right-handed archer.

In order to provide further stability to the cuff 82, a second pair of stabilizer rods 88,90, one each extending from a related stabilizer rod 78 or 80, to the base 20. The rods 88,90 are secured to their associated rod 78,80 by any suitable means, such as, by welding or the like. The other end of the rods 88,90 are secured to the base 20 by any suitable means such as via seating apertures formed in the base and the like.

It should further be noted with respect hereto that the stabilizer bar 72 has a receptor portion 92 which seats the free end of the grip 86 to render the grip stable.

In order to render the present device fully utilitarian it is equipped with standard archery accoutrements. For example, a nocking point 94 is mounted on the intermediate portion of the drawstring 48. Likewise, an arrow rest 96 is disposed on the cross-bar 14.

Also, a peepsight 98 is mounted onto the cross-bar 14 via a mounting member 100. The mounting bar 100 is secured to the cross-bar via any suitable fastening means, such as threaded fasteners or the like. The bar 100 has a channel 102 formed therein in which the peepsight is slidable to accommodate the user. Of course, other attachments, such as, kisser buttons, etc. can be employed.

It is to be appreciated from the preceding that there has been described herein a short-range archery device which facilitates the drawing of the drawstring while providing an effective tension-varying ability.

Having thus, described the invention what is claimed is:

1. An archery device, comprising:

a frame;

an elongate first leg having an outer face, angularly and outwardly projecting from the frame;

a first pulley rotatably mounted onto the first leg;

an elongate second leg having an outer face, the second leg being spaced apart from the first leg and projecting angularly and outwardly from the frame;

a second pulley rotatably mounted onto the second leg;

a third pulley mounted on the frame and disposed proximate the first leg;

a fourth pulley mounted on the frame and disposed proximate the second leg;

the legs and the pulleys being substantially coplanar in a plane substantially normal to the plane of the frame;

a drawstring spanning the frame and being spaced therefrom, the drawstring having a first end secured to the first leg and a second, opposite end secured to the second leg, the drawstring comprising first and second elastomeric end portions and an intermediate string section;

means for varying the tension on the drawstring; secured to at least one end thereof comprising:

a first block positionally mountable onto the first leg, the first end of the drawstring being connected to the first block; and a second block positionally mountable onto the second leg, the second end of the drawstring being connected to the second block;

a universal elbow-engaging rotatable stabilizer adapted to be used by either a right or left-handed operator; and wherein the first elastomeric end portion engages the first and third pulleys and the second elastomeric end portion engages the second and fourth pulleys.

2. The device of claim 1, wherein the universal elbow-engaging stabilizer assembly comprises:

a stabilizer bar, the opposite ends of which are secured to the frame;

a first pair of spaced apart stabilizer rods, each having a first end fixed to the bar;

a generally rectangular stabilizer cuff, which is freely rotatably mounted onto a second end of each of the first pair of stabilizer rods, and which engages the elbow of the user; and a second pair of stabilizer rods, each extending from one of the first pair of rods to the frame.

3. An archery device, comprising:

a frame;

an elongate first leg having an outer face, angularly and outwardly projecting from the frame;

a first pulley rotatably mounted onto the first leg;

an elongate second leg having an outer face, the second leg being spaced apart from the first leg and projecting angularly and outwardly from the frame;

a second pulley rotatably mounted onto the second leg;

a first shaft angularly and outwardly projecting from the frame proximate the first leg and having a free end thereof;

a third pulley mounted on the free end of the first shaft;

a second shaft angularly and outwardly projecting from the frame proximate the second leg and having a free end thereof;

a fourth pulley mounted on the free end of the second shaft;

the legs and the pulleys being substantially coplanar in a plane substantially normal to the plane of the frame;

a drawstring spanning the frame and being spaced therefrom, the drawstring having a first end secured to the first leg and a second, opposite end secured to the second leg, the drawstring comprising first and second elastomeric end portions and an intermediate string section;

means for varying the tension on the drawstring; secured to at least one end thereof; and wherein the first elastomeric end portion engages the first and third pulleys and the second elastomeric section engages the end portion and fourth pulleys.

4. The device of claim 3 in which the means for varying the tension on the drawstring comprises:

a first block positionally mountable onto the first leg, the first end of the drawstring being connected to the first block; and a second block positionally mountable onto the second leg, the second end of the drawstring being connected to the second block.

5. The device of claim 3 which further comprises:

a grip secured to the frame.

6. The device of claim 3 further comprising:

means for adjusting the positions of the first and second shafts.

* * * * *